United States Patent [19]

Wöhrle et al.

[11] Patent Number: 4,934,310

[45] Date of Patent: Jun. 19, 1990

[54] COATING APPARATUS FOR COATING MOVING SHEET

[75] Inventors: Albert Wöhrle; Franz Krautzberger, both of Heidenheim, Fed. Rep. of Germany

[73] Assignee: J.M. Voith GmbH, Heidenheim, Fed. Rep. of Germany

[21] Appl. No.: 27,106

[22] Filed: Mar. 13, 1987

Related U.S. Application Data

[63] Continuation of Ser. No. 737,178, May 23, 1985, abandoned.

[30] Foreign Application Priority Data

Jun. 1, 1984 [DE] Fed. Rep. of Germany ..... 3420412

[51] Int. Cl.[5] ..... B05C 3/02

[52] U.S. Cl. ..... 118/410; 118/413; 427/356

[58] Field of Search ..... 118/410, 413; 427/356, 427/358

[56] References Cited

U.S. PATENT DOCUMENTS 4,369,731 1/1983 Damrau ..... 118/413 X 4,405,661 9/1983 Alheid ..... 118/410 X 4,452,833 6/1984 Holt ..... 427/356

4,688,516 8/1987 Sommer ..... 118/410

FOREIGN PATENT DOCUMENTS 95770 2/1973 German Democratic Rep. ..... 118/410

*Primary Examiner*—Shrive Beck

*Assistant Examiner*—Alain Bashore

*Attorney, Agent, or Firm*—Grimes & Battersby

[57] ABSTRACT

Coating apparatus is provided for use in coating a sheet of goods which is carried on a counter-roller. The coating apparatus includes a coating zone which is formed along the sheet to be coated. At least one deflector is provided in the coating zone for deflecting the return flow of coating material deflected at the coating blade to a divergence angle of less than 90 degrees relative to the emerging flow of fresh coating material from the outlet port of the chamber containing the coating material. In general, angle of divergence between the two opposing flows of coating material is less than 60 degrees. In this manner, the amount of agitation and turbulence in the flow of material is minimized.

12 Claims, 1 Drawing Sheet

COATING APPARATUS FOR COATING MOVING SHEET

This application is a continuation, of application Ser. No. 06/737,178, filed May 23, 1985 now abandon.

BACKGROUND OF THE INVENTION

The present invention relates generally to coating apparatus and, more particularly, to coating apparatus adapted to evenly and uniformly apply a coating material to a moving sheet of goods with little or no streaking.

In order to achieve an even and uniform application of a coating material on a moving sheet of goods, the amount of air which is introduced at the point of coating, i.e., the coating zone, must be minimized. An example of coating apparatus which is intended to eliminate or minimize the introduction of air into the coating zone is the apparatus described in U.S. Pat. No. 4,250,211. In the apparatus of this patent, the coating material emerges from a chamber or reservoir and is introduced into a coating zone through a slotted outlet port. The coating material is maintained under pressure in this coating zone.

The coating zone of the apparatus described in U.S Pat. No. 4,250,211 is bound or defined by the sheet of goods to be coated which is carried around a guide cylinder; an anterior throttle plate; the opening of the outlet port of the chamber; and a coating blade. The coating material emerges from the coating zone through a throttle slit which is created between the anterior throttle plate and the moving sheet of goods in a direction opposite the direction of the movement of the sheet. Such a configuration serves to reduce the amount of air which is introduced into the coating zone and, as such, is able to effect the coating operation relatively unimpeded by air pockets.

One of the inherent problems with such apparatus, however, is that the coating material tends to streak as it is applied to the sheet. This streaking is due to ripples which develop in the coating material within the coating zone. As can be readily appreciated, streaking of the coating material on the sheet of goods can prove commercially unacceptable.

Against the foregoing background, it is primary object of the present invention to provide coating apparatus which can uniformly and evenly apply a coating to a sheet of goods.

It is another object of the present invention to provide such coating apparatus where the amount of air which is introduced into the coating zone of the apparatus is minimized.

It is still another object of the present invention to provide such coating apparatus which will not streak the coating material on the sheet of goods to be coated.

SUMMARY OF THE INVENTION

To the accomplishments of the foregoing objects and advantages, the present invention, in brief summary, comprises apparatus for applying a coating material to a moving sheet of goods which is carried on a rotatable cylinder or counter-roller. The apparatus includes a chamber for delivering the coating material into a coating zone through the mouth of an outlet port and a coating blade for deflecting the coating material and returning excess material back into the chamber. The coating zone is defined by an anterior throttle plate, the mouth of the outlet port and the coating blade. Deflector means are provided in the coating zone to further deflect the returning flow of coating material deflected by the coating blade relative to the emerging flow of fresh coating material from the outlet port. The angle of divergence between the returning flow of coating material and the emerging flow of fresh coating material from outlet port is less than 90 degrees.

Deflectors may be provided at either end of the diverter means so that the angle of divergence is less than 60 degrees.

In an alternative embodiment of the apparatus of the present invention, a baffle may be provided which extends into the coating zone from the chamber. In such embodiment, the outlet port is defined by the baffle and an anterior wall of the chamber and a return port is defined by the baffle and a posterior lateral wall of the chamber for the return of coating material from the coating zone. The baffle may form a throttle-type slot for directing the coating material against the sheet to be coated.

In such alternative embodiment, the end of the baffle which is contained in the chamber may be curved or rounded and a curved deflector is provided within the chamber opposite the rounded end of the baffle. The combination of the two serves to divert the returning flow of coating material and the angle of divergence between the returning flow of coating material and the emerging flow of coating material is less than 90 degrees.

BRIEF DESCRIPTION OF THE DRAWINGS

The foregoing and still other objects and advantages of the present invention will be more apparent from the following detailed explanation of the preferred embodiments of the invention in connection with the accompanying drawings wherein.

DESCRIPTION OF THE PREFERRED EMBODIMENTS

Figure 1:
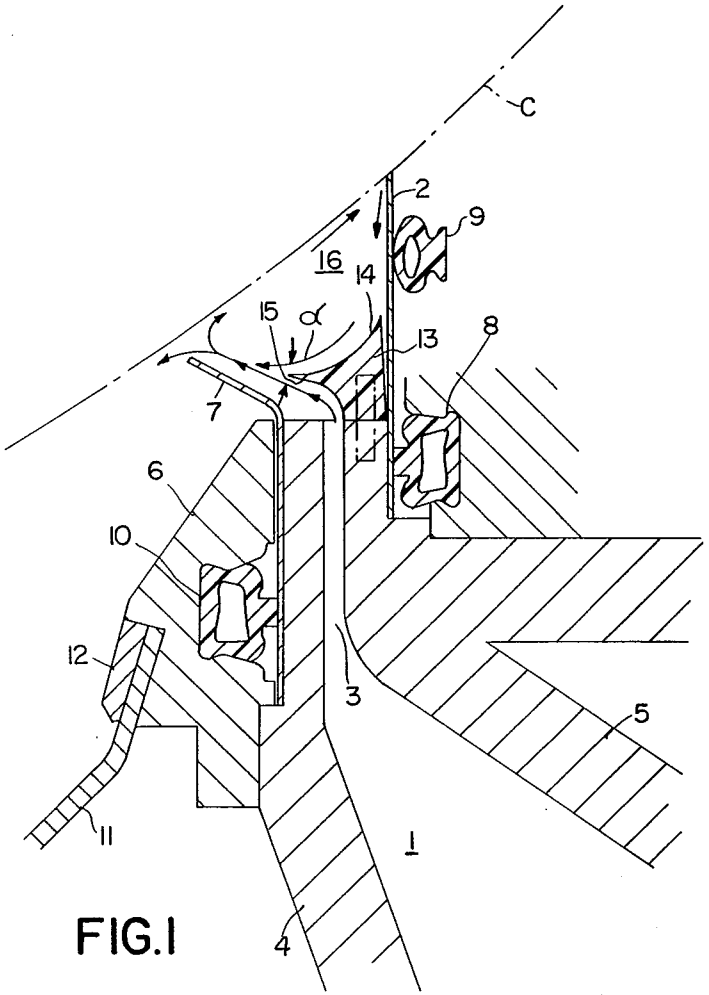
FIG. 1 is a sectional view of one version of the coating equipment of the present invention.

The coating apparatus of the present invention, which is illustrated generally in FIG. 1 thereof, includes a reservoir or chamber 1 adapted to store the coating material which is to be applied to a moving sheet of goods which is carried on a counter-roller C. The chamber 1 is defined by lateral walls 4 and 5. Anterior lateral wall 4 supports an anterior throttle plate 7 by means of a shim 6 and terminates against counter-roller C. The coating material is delivered from the chamber 1 into a coating zone 16 through an outlet port 3. The coating blade 2 is provided for evenly applying the coating material on the sheet against the sheet being coated and for deflecting excess coating material and initiating a return flow of such excess material back into the chamber 1.

The emerging flow of the coating material from chamber 1 through outlet port 3 and into coating zone 16 for application against the sheet on the counter-roller C is represented by the arrows. A pre-determined amount of coating material contained in the coating zone 16 is applied against the sheet of goods as it is carried on counter-roller C in the direction of the arrow.

The coating zone 16 of the apparatus of the present invention is bounded or defined by the counter-roller C which carries the sheet of goods to be coated, the upper portion of the anterior throttle plate 7, the mouth of outlet port 3 of the chamber 1, the coating blade 2 and, additionally, by a guide hull 13 which is positioned at the mouth of chamber 1. Guide hull 13, which is attached to the end of the posterior wall 5 of the chamber 1, includes deflectors 14 and 15 at its opposite ends. Guide hull 13 may be fabricated at least partially of rubber or of any other easily molded material so that, if necessary, it can easily be bent to the desired deformation of the coating blade 2 induced by contact from pressure tubing 9.

One end of the coating blade 2 is attached to the posterior wall 5 of chamber 1 by pressure tubing 8. The opposite end of the coating blade 2 is adapted to contact and ride against the sheet which is carried on counter-roller C. Deformation of the coating blade 2 is effected by pressure tubing 9.

Anterior throttle plate 7 is secured between a shim 6 and the anterior lateral wall 4 by pressure tubing 10. A baffle 11 is secured to shim 6 by a retaining strip 12 and serves to remove any excess coating material from the coating zone 16 which may flow over the upper edge of the throttle plate 7.

The actual flow of the coating material within the coating zone 16 is represented by the arrows. As the chamber 1 is opened, an emerging flow coating material passes through outlet port 3 and is deflected by first deflector 15 on guide hull 13 in a direction opposite to the direction of rotation of the sheet of goods to be coated on counter-roller C. The coating material then contacts the sheet on the counter-roller C and is carried along with the flow of the sheet of goods.

A second deflection of the coating material occurs at coating blade 2 and a return flow is initiated. This second deflection of the coating material serves to reduce the streaking in the coating process since the coating material does not leave the coating zone 16 as a streak. The return flow of coating material caused by the reflection of the coating blade 2, and which otherwise would have causing streaking, is directed downwardly where it contacts and is again deflected by second deflector 14 on the guide hull 13. This second deflection results in two, substantially opposed flows of coating material in the coating zone, i.e., the emerging flow out of the outlet port 3 and in the direction of rotation of the counter-roller C and the returning flow after deflection by the coating blade 2 and the second deflector 14. The angle $\alpha$ of divergence, i.e., the angle formed between the two velocity vectors described by the aforementioned flows of the coating material, is less than 90 degrees and preferably no greater than 60 degrees. In a particularly preferred embodiment, the angle of divergence is less than 40 degrees.

Figure 2:
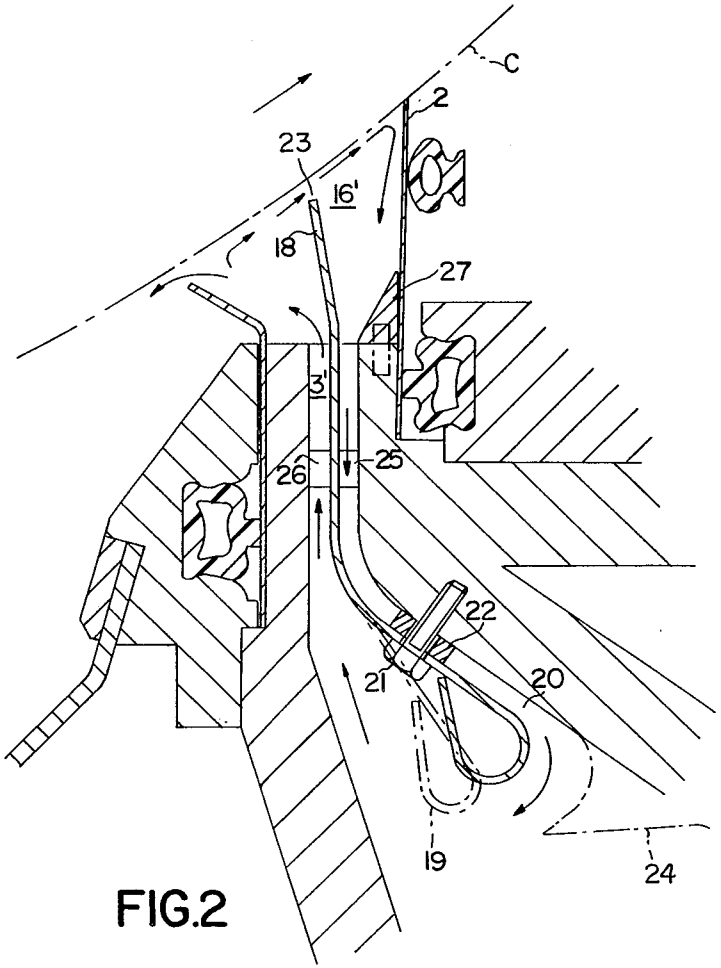
FIG. 2 is a sectional view of an alternative version of the coating equipment of the present invention.

An alternative embodmiment of the coating apparatus of the present invention is illustrated in FIG. 2. The coating apparatus of this embodiment utilizes essentially the same chamber as in FIG. 1, but contains a uniquely configured baffle arrangement.

In the embodiment of FIG. 2, the chamber 1 and the passageway from the chamber 1 to the coating zone 16' are divided into two channels, i.e., an outlet port 3' and a return port 20, by a baffle 18 which extends from chamber 1 into the coating zone 16'. Outlet port 3' is defined by the anterior lateral wall 4 and the baffle 18 and return port 20 is defined by the posterior lateral wall 5 and the baffle 18. Outlet port 3' is adapted to permit introduction of the emerging flow of the coating material into the coating zone 16' while the return channel 20 is adapted to permit the returning flow of coating material which is deflected by the coating blade 2 back into the chamber 1.

Baffle 18, which is secured to the posterior lateral wall 5 of the chamber 1 by a spacer 22 and a screw 21, divides the chamber 1 into approximately equal portions along its axial length. The end 19' of baffle 18 contained within the chamber 1 is rounded to facilitate entry of the returning flow of the coating material back into the chamber 1. Spacer plates 25 and 26 are provided to maintain the position of baffle 18 and to maintain the required distance of the baffle 18 to the anterior lateral wall 4 and to the posterior lateral wall 5, especially in the area of outlet port 3' of the chamber 1.

The dotted lines indicate another curve of baffle 18 at its end located in chamber 1 as well as an additional guide hull 24. The returning flow of the coating material is deflected around the baffle 18 at the lower end of channel 20 by the rounded bottom portion 19' of the baffle 18 and by the curved portion of the guide hull 24. The lower end of channel 20 thereby deflects the returning flow of the coating material back into the chamber 1. The angle of divergence, i.e., the angle between the emerging flow of coating material from chamber 1 and the returning flow of coating material into chamber 1, is less than 90 degrees. In this manner, the least possible disruption of the smooth flow within the chamber 1 is achieved similar to that in the configuration of FIG. 1. Thus, only the slightest drop in pressure occurs.

In addition, a guide hull 27 consisting preferably of rubber or of a slightly elastic, moldable synthetic material which would prevent turbulence in the wedge between the chamber opening and the coating blade 2 is provided.

As indicated by the arrows, the emerging flow of coating material flows outwardly from the chamber 1 into the coating zone 16' through outlet port 3'. The coating material thereupon contacts the sheet of goods to be coated which is carried on counter-roller C and passes through the space 23 provided between the baffle 18 and the sheet of goods. The coating material is then deflected downwardly by coating blade 2 and the returning flow of coating material is introduced into the return channel 20. The returning flow of coating material then passes between the rounded end 19' of baffle 18 and the guide hull 24 and contacts the coating material already contained in the chamber 1.

Having thus described the invention with particular reference to the preferred forms thereof, it will be obvious that various changes and modifications may be made therein without departing from the spirit and scope of the invention as defined by the appended claims.

Wherefore, we claim:

1. An apparatus for applying a coating material to a moving sheet, said apparatus including:

(a) a chamber for retaining said coating material and having an anterior wall;

(b) an outlet port connecting said chamber to a coating zone and providing a flow path for said coating material from said chamber to said coating zone;

(c) a coating blade for applying a main portion of said coating material on said sheet and for deflecting an excess portion of the main portion of said coating material from said sheet towards said chamber as said sheet moves adjacent said coating blade; and (d) a guide hull located between said coating blade and said outlet port, said guide hull including a first deflector surface and a second deflector surface, said first deflector surface positioned between said outlet port and said coating blade and having a substantially arcuate shape, said first deflector surface for deflecting in said coating zone the excess portion of said coating material towards the main portion of said coating material to merge the excess portion back with the main portion of said coating material so that the excess portion maybe reapplied to the moving web, wherein an angle is formed where the main and excess portions of said coating material merge, said angle being at a maximum of 90 degrees, said second deflector surface for deflecting the emerging flow of the main portion of said coating material from said outlet port into said coating zone, wherein said anterior wall, said outlet port, said guide hull, and said doctor blade define said coating zone, said coating zone having a minimum amount of air introduced therein as the main portion of said coating material is applied to said sheet.

2. The apparatus of claim 1, wherein said angle is less than 60 degrees.

3. The apparatus of claim 1, wherein said guide hull further includes another deflector surface for deflecting the main portion of said coating material from said outlet port into said coating zone.

4. The apparatus of claim 1, wherein said guide hull is made of an elastic moldable synthetic material which minimizes, if not prevents, turbulence in said coating zone.

5. The apparatus of claim 1, wherein said outlet port is a port of said chamber.

6. The apparatus of claim 1, further including a baffle extending from said chamber to form a portion of said anterior wall.

7. The apparatus of claim 1, wherein said guide hull and said second deflector surface form an acute angle of less than 50 degrees.

8. An apparatus for applying a coating material to a moving sheet, said apparatus including:

(a) a chamber for retaining said coating material and having an anterior wall;

(b) an outlet port connecting said chamber to a coating zone and providing a flow path for said coating material;

(c) a baffle extending from said chamber through said outlet port into said coating zone for separating said outlet port into a first channel and a second channel, said first channel transmits a main portion of said coating material from said chamber to said coating zone, and said second chamber transmits an excess portion of the main portion of said coating material from said coating zone to said chamber;

(d) a first guide hull located in said chamber and including a deflector surface for deflecting the excess portion of said coating material towards the main portion of said coating material in said chamber to merge the excess and main portions, wherein an angle is formed where the main and excess portions merge, said angle being at a maximum of 90 degrees;

(e) a coating blade for applying the main portion of said coating material received from said first channel on said sheet and for deflecting the excess portion of said coating material from said sheet towards said second channel;

(f) a second guide hull located between said coating blade and said second channel for preventing turbulence in a portion of said coating zone between said coating blade and said second channel, wherein said anterior wall, said outlet port, said second guide hull, said coating blade and said sheet define said coating zone, said coating blade having a minimum amount of air introduced therein as the main portion of said coating material is applied to said sheet.

9. The apparatus of claim 8, wherein said baffle has a first end extending into said chamber, and wherein said first end is rounded.

10. The apparatus of claim 9, wherein said deflector surface is located in said chamber opposite said rounded first end of said baffle so that said deflector surface and said rounded first end define a passage for deflecting the excess portion of said coating material into the main portion of said coating material.

11. The apparatus of claim 9, wherein said first guide hull and said second guide hull each is made of an elastic moldable synthetic material which minimizes, if not prevents, turbulence in said coating zone.

12. An apparatus for applying a coating material to a moving sheet, said apparatus including:

(a) a chamber for retaining said coating material and having an anterior wall;

(b) an outlet port connecting said chamber to a coating zone and providing a flow path for said coating material;

(c) a baffle extending from said chamber through said outlet port into said coating zone for separating said outlet port into a first channel and a second channel, said first channel transmits a main portion of said coating material from said chamber to said coating zone, and said second chamber transmits an excess portion of the main portion of said coating material from said coating zone to said chamber;

(d) a first guide hull located in said chamber and including a deflector surface for deflecting the excess portion of said coating material towards the main portion of said coating material in said chamber to merge the excess and main portions, wherein an angle is formed where the main and excess portions merge, said angle being at a maximum of 90 degrees; and (e) a coating blade for applying the main portion of said coating material received from said first channel on said sheet and for deflecting the excess portion of said coating material from said sheet towards said second channel, wherein said anterior wall, said outlet port, said coating blade and said sheet define said coating zone, said coating blade having a minimum amount of air introduced therein as the main portion of said coating material is applied to said sheet.

* * * * *